US006604560B2

(12) United States Patent
Ikemoto et al.

(10) Patent No.: US 6,604,560 B2
(45) Date of Patent: Aug. 12, 2003

(54) PACKAGING PROCESSING APPARATUS IN A PACKAGING MACHINE

(75) Inventors: Iwao Ikemoto, Iwakuni (JP); Shoichi Koga, Iwakuni (JP)

(73) Assignee: Toyo Jidoki Co., Ltd., Tokyo (JP)

( * ) Notice: Subject to any disclaimer, the term of this patent is extended or adjusted under 35 U.S.C. 154(b) by 0 days.

(21) Appl. No.: 10/134,155

(22) Filed: Apr. 25, 2002

(65) Prior Publication Data

US 2002/0157728 A1 Oct. 31, 2002

(30) Foreign Application Priority Data

Apr. 27, 2001 (JP) ..... 2001-133173

(51) Int. Cl.[7] ..... B65B 43/42

(52) U.S. Cl. ..... 141/147; 141/146; 141/150; 141/166

(58) Field of Search ..... 141/147, 142, 141/143, 144, 145, 146, 150, 314, 166, 270, 284; 53/381.1, 386.1, 570

(56) References Cited

U.S. PATENT DOCUMENTS 3,419,053 A * 12/1968 Tanner ..... 141/145
4,697,623 A * 10/1987 Bouldin et al. ..... 141/80
4,721,138 A * 1/1988 Simonazzi ..... 141/150
5,219,405 A * 6/1993 Weiss ..... 141/150
5,280,815 A * 1/1994 Jones ..... 141/147
5,749,403 A * 5/1998 Conforti ..... 141/147
6,286,568 B1 * 9/2001 Araki et al. ..... 141/166
6,338,371 B1 * 1/2002 Araki et al. ..... 141/146
6,378,574 B2 * 4/2002 Tsutsui ..... 141/146
6,419,076 B1 * 7/2002 Tsutsui ..... 141/166
6,490,846 B2 * 12/2002 Koppe ..... 53/459

FOREIGN PATENT DOCUMENTS

EP 0927683 A1 * 7/1999
JP H10-305802 11/1998

* cited by examiner

*Primary Examiner*—Gregory L. Huson
*Assistant Examiner*—Khoa Huynh
(74) *Attorney, Agent, or Firm*—Koda & Androlia

(57) ABSTRACT

A packaging processing (liquid filling) apparatus, including a rising-and-lowering assembly attached to a pivot member and moved vertically and filling nozzles attached to the rising-and-lowering assembly. An endless chain having grippers at equal intervals is rotated continuously by a sprocket. A circular first raising-and-lowering cam that rotates with the sprocket is attached to the sprocket, and a circular-arc-shaped second raising-and-lowering cam is provided near the first raising-and-lowering cam; and a cam roller attached to the rising-and-lowering assembly is caused to roll on these cams. When the pivot member makes a forward motion to follow the bags held by grippers, the cam roller rolls over the second raising-and-lowering cam, and the rising-and-lowering assembly is lowered and then raised; when the pivot member makes a return motion, the cam roller rolls over the first raising-and-lowering cam, and the rising-and-lowering assembly is maintained in a raised position.

5 Claims, 5 Drawing Sheets

PACKAGING PROCESSING APPARATUS IN A PACKAGING MACHINE

BACKGROUND OF THE INVENTION

1. Field of the Invention

The present invention relates to a packaging processing apparatus used in a packaging machine.

2. Prior Art

In a typical packaging machine, container holding means are continuously conveyed at a constant speed and uniform spacing along a circular or circular-arc-shaped path, and packaging processing such as filling with a liquid-form substance into containers held by the container holding means, etc. is performed while the container holding means are being conveyed.

Japanese Patent Application Laid-Open (Kokai) No. 10-305802 discloses such a packaging machine. This packaging machine includes a continuously rotating table and an intermittently rocking table. The continuously rotating table is provided on its circumference with numerous grippers that are arranged at uniform intervals. The intermittently rocking table is installed above the continuously rotating table and is raised and lowered at a specified timing. To the circumference of the intermittently rocking table, numerous filling nozzles and capping heads are attached at the same pitch as the pitch of the grippers.

In this packaging machine, containers are continuously conveyed by the grippers. During this conveying action, the intermittently rocking table is raised and lowered and performs a horizontal reciprocating motion at a specified timing. During the advancing motion of the table (when the table swings in the direction same as the direction of movement of the grippers, this is called the advancing motion; and when the table swings in the opposite direction, it is called the return motion), filling processing and capping processing are performed while the filling nozzles and capping heads are lowered and caused to follow the conveying motion of the containers. Then, when the specified advancing motion reaches its end, the filling nozzles and capping heads are raised, the table makes a return motion, and then the table returns to the starting point of its advancing motion.

In this packaging machine, in order to raise and lower the filling nozzles and capping heads and cause these elements to perform a reciprocating motion, the intermittently rocking table is used that is supported by a suspension rod around which a compression spring is wound, an upper supporting plate on which the suspension rod is installed is attached to a rising-and-lowering shaft which passes through the center of the continuously rotating table, and the rising-and-lowering shaft is raised and lowered by a first cam. In addition, a retaining plate that is engaged with the suspension rod is installed on a hollow shaft (through which the rising-and-lowering shaft is passed), and the hollow shaft is caused to make a reciprocating pivot motion by a second cam.

As seen from the above, the rising-and-lowering and reciprocating swing mechanism of the filling and capping apparatus of the above-described packaging machine is extremely complicated. Accordingly, it not only increases the cost but also causes a conspicuous drop in maintenance and cleaning characteristics. Furthermore, the rising-and-lowering driving section supports not only the intermittently rocking table but also the rising-and-lowering shaft, upper supporting plate, suspension rod and compression spring, and further it must raise and lower these elements. Consequently, if the load is taken into consideration, the structure must be strong and durable, but this increases the size of the apparatus unavoidably.

SUMMARY OF THE INVENTION

Accordingly, the present invention is to solve the above-described problems with a packaging processing apparatus that performs packaging processing such as filling, etc. in a packaging machine.

In other words, the object of the present invention is to provide an improved packaging processing apparatus that has a simplified mechanism for its rising-and-lowering and reciprocating swing motions, thus reducing the cost, improving the maintenance and cleaning characteristics and further reducing the size of the apparatus.

The above object is accomplished by a unique structure for a packaging processing apparatus used in a packaging machine, the packaging machine comprising:

a rotating body (sprocket, for instance) that is attached to a rotating shaft connected to a driving means, the rotating body being rotated at a constant speed on a horizontal plane, and a plurality of container holding means (gripper pairs) that are, upon rotation of the rotating body, moved continuously at a constant speed and a uniform spacing along a circular or circular-arc-shaped traveling path around a circumference of the rotating body; and specified packaging processing operations are performed, by a plurality of packaging processing means (filling nozzles, for instance), on containers during a movement of respective container holding means along the circular or circular-arc-shaped traveling path, the packaging processing means being arranged in a form of a circular arc so as to correspond to the container holding means at a same pitch as the containers held by the container holding means and performing a synchronous movement for a specified angular range at a same speed as the containers held by the container holding means, wherein the packaging processing apparatus is comprised of:

(i) a pivot member which is disposed above the rotating body, the pivot member being concentric with the rotating shaft and being connected to a driving means so that the pivot member performs a reciprocating pivot motion on a horizontal plane, (ii) a rising-and-lowering assembly which is disposed on the pivot member so that the rising-and-lowering assembly is raised and lowered and pivoted together with the pivot member, (iii) a circular first raising-and-lowering cam which is disposed concentrically with the rotating body and rotated together with the rotating body, (iv) a circular-arc-shaped second raising-and-lowering cam which is provided concentrically with the rotating body above the rotating body, (v) a rolling member (cam roller) which is attached to the rising-and-lowering assembly and rolls over cam surfaces of the first and second raising-and-lowering cams so that the rising-and-lowering assembly is raised and lowered at a specified timing, and (vi) a plurality of packaging processing means which are disposed on the rising-and-lowering assembly and perform a reciprocating motion as the pivot member pivots; and the rising-and-lowering assembly is subjected to an action of the second raising-and-lowering cam during an advancing motion of the pivot member and is subjected to an action of the first raising-and-lowering cam during a return motion of the pivot member.

In this structure, when the pivot member is moved during its pivot motion in the same direction as the direction of movement of the container holding means, this is referred to as an advancing motion; and when the pivot member is moved in the opposite direction, then this is referred to as a return motion.

The rising-and-lowering assembly is lowered and raised during the advancing motion of the pivot member and is maintained in a raised position during the return motion of the pivot member.

More specifically, the first raising-and-lowering cam is provided with a cam surface that has a uniform height and a plurality of recessed portions that are formed at predetermined angular intervals, and the second raising-and-lowering cam is provided on both sides thereof with cam surfaces that has substantially the same height as the cam surface of the first raising-and-lowering cam and is further provided with a lower-height cam surface between the cam surfaces on both sides.

With this structure, a setting is made so that during the advancing motion of the pivot member, the rolling member is positioned in one of the recessed portions of the first raising-and-lowering cam and rolls over the cam surface of the second raising-and-lowering cam, thus allowing the rising-and-lowering assembly to be lowered and raised; and during the return motion of the pivot member, the rolling member rolls over the cam surface of the first raising-and-lowering cam, thus allowing the rising-and-lowering assembly to be maintained in the raised position.

In the present invention, the packaging processing means are, for instance, filling nozzles for a liquid-form substance (thus, the packaging processing apparatus is a liquid filling apparatus). However, the packaging processing means can be capping heads, gas substitution nozzles, inner sealing heads (heads that heat-seal aluminum foil on the mouths of spouts), and the like.

Furthermore, the present invention can be used not only in cases where the container holding means (grippers) are disposed at equal intervals on the circumference of a continuously rotating body (rotating table) as in the above-described conventional machine (with the container holding means moving over a circular traveling path) but also in cases where, for example, the rotating body is a continuously rotating sprocket, and an endless chain on which the container holding means (grippers) are disposed at equal intervals is mounted on the sprocket (with the container holding means moving over a circular-arc-shaped traveling path at the location of the sprocket). Furthermore, the present invention is applicable to cases where the containers (bags) are inserted into retainers and continuously conveyed (in this case, the retainers are the "container holding means").

DETAILED DESCRIPTION OF THE INVENTION

Figure 1:
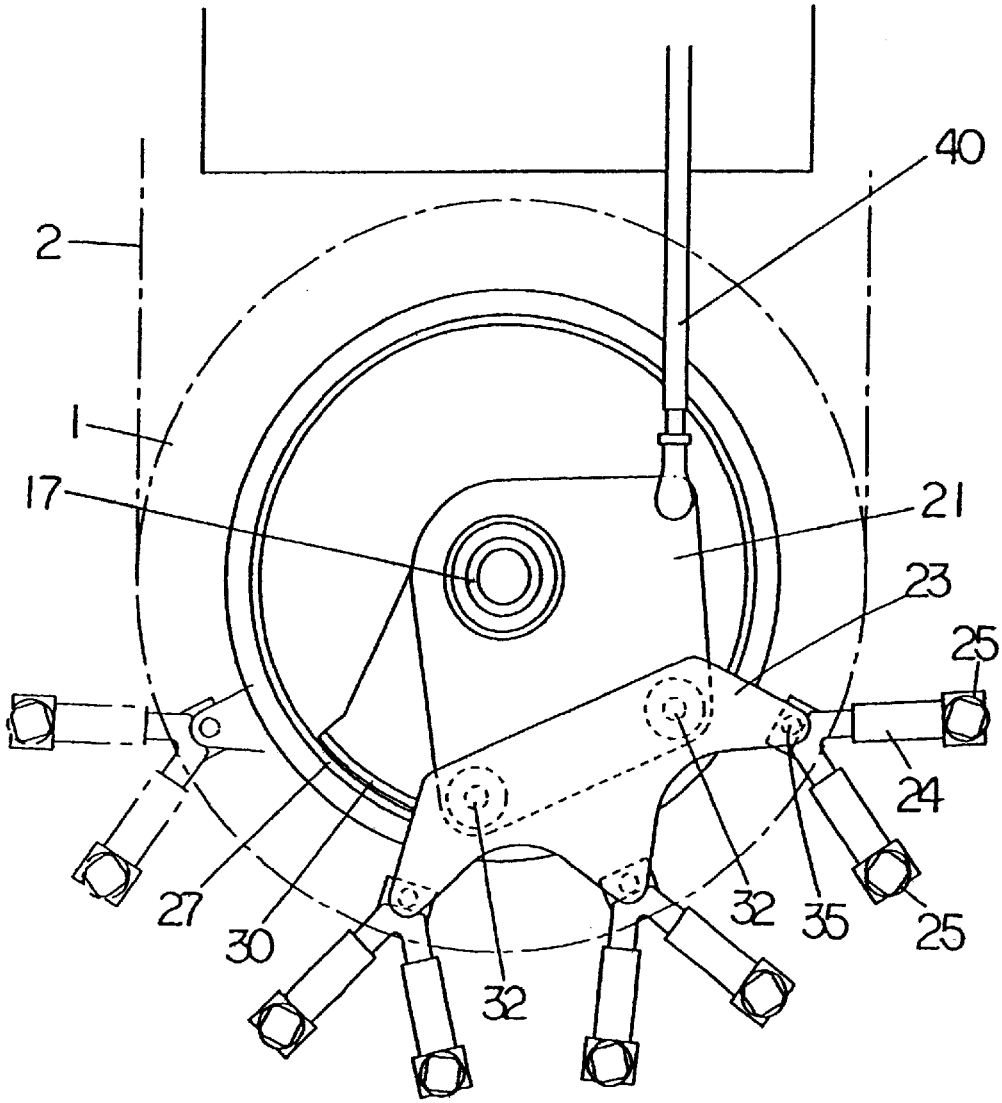
FIG. 1 is a top view of the packaging processing apparatus according to the present invention.

The packaging processing apparatus of the present invention will be described below in a concrete manner with reference to FIGS. 1 through 5.

In the packaging machine for the shown embodiment of the packaging processing apparatus, a endless chain 2 is mounted on a sprocket 1 that is rotated continuously (in the clockwise direction in FIG. 1), and numerous gripper pairs 3 that grip both edges of bags W are attached to the endless chain 2 at equal intervals. Thus, the gripper pairs 3 are moved (or rotated) continuously at a constant speed.

During the movement of the gripper pairs 3 over a circular-arc-shaped traveling path (that correspond to the area of the sprocket 1), the packaging processing apparatus (in this embodiment, a liquid-form substance filling apparatus) fills the bags W with a liquid-form substance.

In the packaging machine, though not shown, a bag supplying device which supplies bags to the gripper pairs 3, a bag mouth opening device, a solid matter filling device and a sealing device, etc. are disposed in positions located on the movement path of the endless chain 2.

Figure 2:
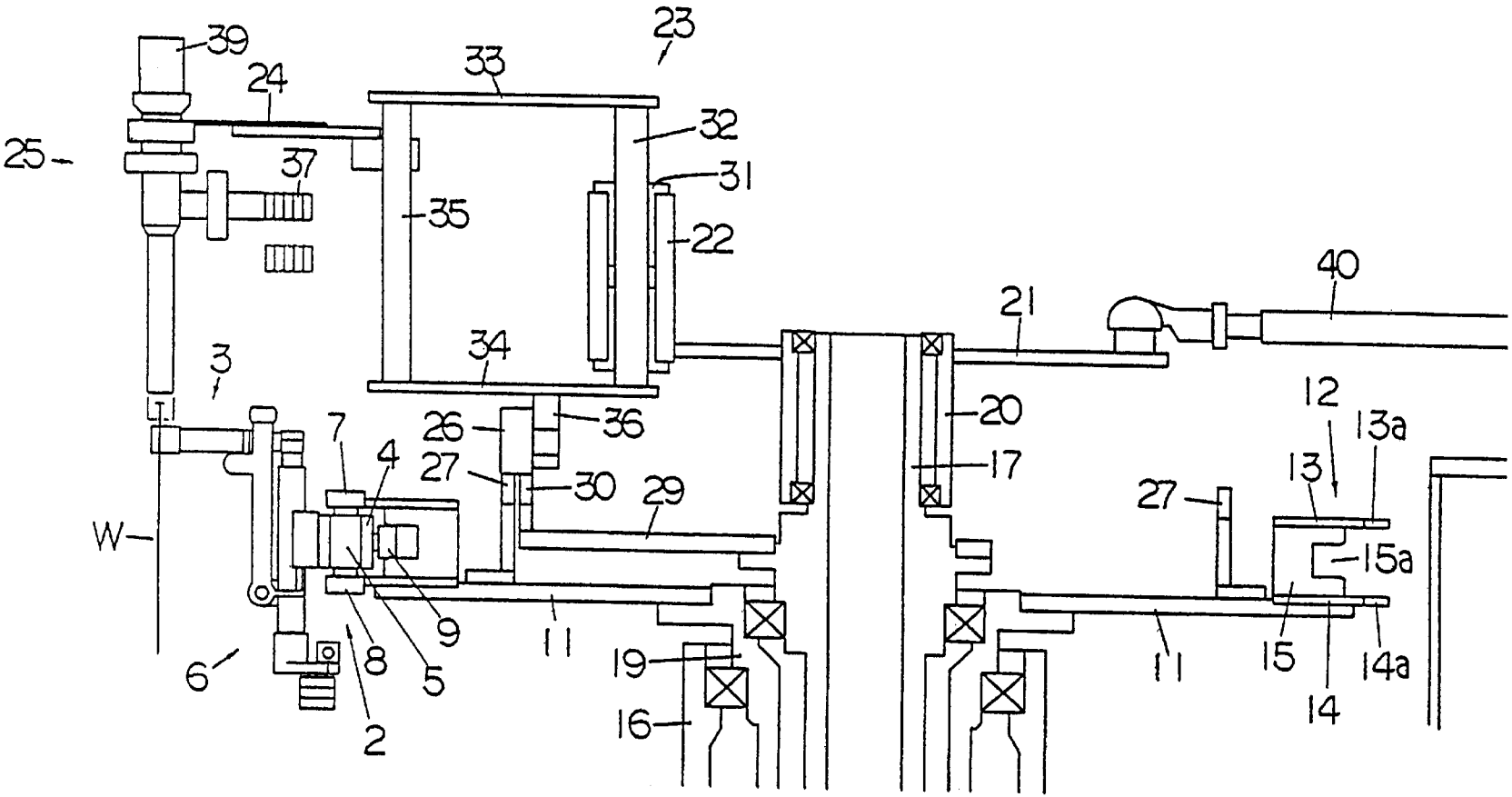
FIG. 2 is a sectional front view thereof.
Figure 3:
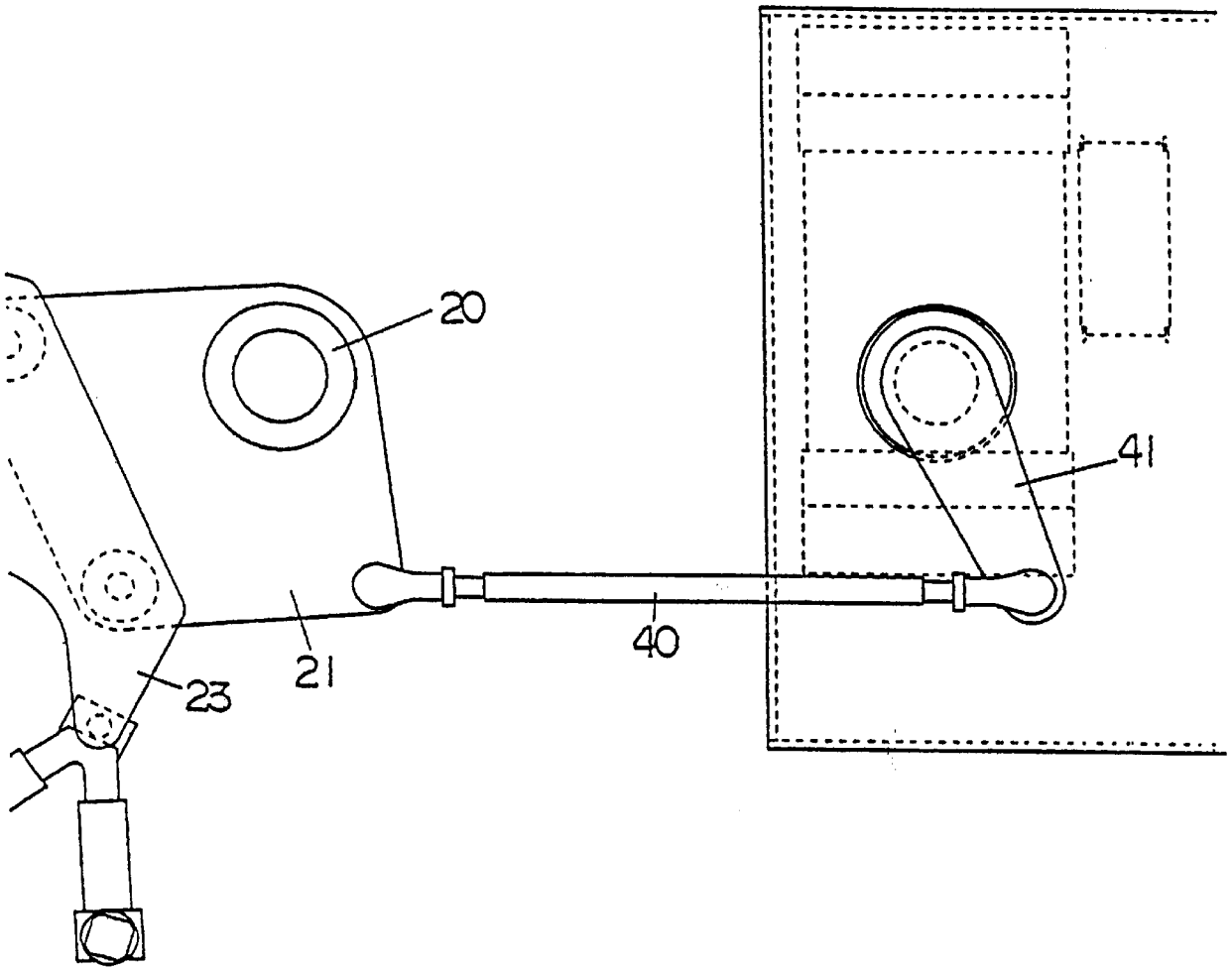
FIG. 3 is a top view showing the driving mechanism of the pivot member.

As seen from FIG. 2, the endless chain 2 is comprised of numerous links 4 (only one link element shown) that are connected in an endless configuration via connecting shafts 5. Gripper pairs 3 and operating mechanisms 6 (operated by a cam, etc., that is disposed along the movement path of the endless chain 2) that open and close the gripper pairs 3, etc. are attached to the side surfaces of the respective links 4. Furthermore, upper rollers 7 and lower roller 8 are disposed above and below the connecting shafts 5, and inside rollers 9 are disposed on the insides of the links 4. In areas other than the area of the sprocket 1, the rollers 7 through 9 run over a guide member (not shown) that is disposed along the movement path of the endless chain 2.

The sprocket 1 has a circular attachment plate 11 and a tooth section 12 that is attached to the circumference of the attachment plate 11. The tooth section 12 is comprised of upper and lower ring-form members 13 and 14 and a central ring-form member 15. The upper and lower ring-form members 13 and 14 have recessed portions 13*a* and 14*a* that are formed at specified intervals, and the upper and lower rollers 7 and 8 of the endless chain 2 are engaged with the recessed portions 13*a* and 14*a*. The central ring-form member 15 has in its circumference a groove 15*a* so that the corresponding inside roller 9 of the endless chain 2 is inserted in the groove 15*a*.

As a result of the upper and lower rollers 7 and 8 engaging with the recessed portions 13*a* and 14*a* of the sprocket 1, the rotation of the sprocket 1 is transmitted to the endless chain 2, and the endless chain 2 is moved (rotated).

A stand 16 is fastened to a base (not shown), and a first hollow shaft 17 is fastened in place so as to be at the center of the stand 16. A second hollow shaft 19 is rotatably supported between the stand 16 and the first hollow shaft 17, and the second hollow shaft 19 is rotated continuously at a constant speed by a driving means (not shown). The attachment plate 11 of the sprocket 1 is fastened to the second hollow shaft 19.

The liquid-form substance filling apparatus (the packaging processing apparatus) comprises, among other elements, a pivot tube 20 rotatably supported on the circumference of the first hollow shaft 17, a pivot member 21 mounted on the pivot tube 20 and performs a reciprocating pivot motion on a horizontal plane, bearing members 22 fastened to one end of the pivot member 21, a rising-and-lowering assembly 23 attached to the bearing members 22 so as to be freely raised and lowered, six filling nozzles 25 attached to the rising-and-lowering assembly 23 via brackets 24 (these nozzles 25 are the "packaging processing means"), a cam roller 26 attached to the lower portion of the rising-and-lowering assembly 23 (the cam roller 26 is the "rolling member"), a circular (concentric with the sprocket 1) first raising-and-lowering cam 27 fastened to the upper surface of the attachment plate 11, and a circular-arc-shaped (concentric with the sprocket 1) second raising-and-lowering cam 30 fastened to the first hollow shaft 17 via an attachment plate 29.

The rising-and-lowering assembly 23 is comprised of rising-and-lowering shafts 32 that slide along bushes 31 held inside the bearing members 22, upper and lower plates 33 and 34, and attachment shafts 35. The brackets 24 are fastened to the attachment shafts 35, and the cam roller 26 is fastened to the lower plate 34 via an attachment member 36.

The filling nozzles 25 are arranged in a circular arc configuration (concentric with the sprocket 1) at the same pitch as the bags W held by the grippers 3. The filling nozzles 25 are respectively equipped with mouth fittings 37, which are connected to a liquid-form substance metering device via flexible hoses, and air cylinders 39, which are used to open and close the discharge ports of the filling nozzles 25. The filling nozzles 25 are arranged so that a specified amount of a liquid-form substance is discharged at a specified timing.

The pivot member 21 is connected to a swing lever 41 with a connecting rod 40 in between. The swing lever 41 is connected to a continuously rotating driving source (not shown) via, for instance, an index unit (not shown) and performs a reciprocating swing motion at a specified timing.

The first raising-and-lowering cam 27 and second raising-and-lowering cam 30 are disposed adjacent to each other, and a common cam roller 26 is provided so as to roll over the cam surfaces of these cams. It is, however, also possible to provide cam rollers so as to respectively roll over the cam surfaces of the first raising-and-lowering cam 27 and second raising-and-lowering cam 30.

Figure 4:
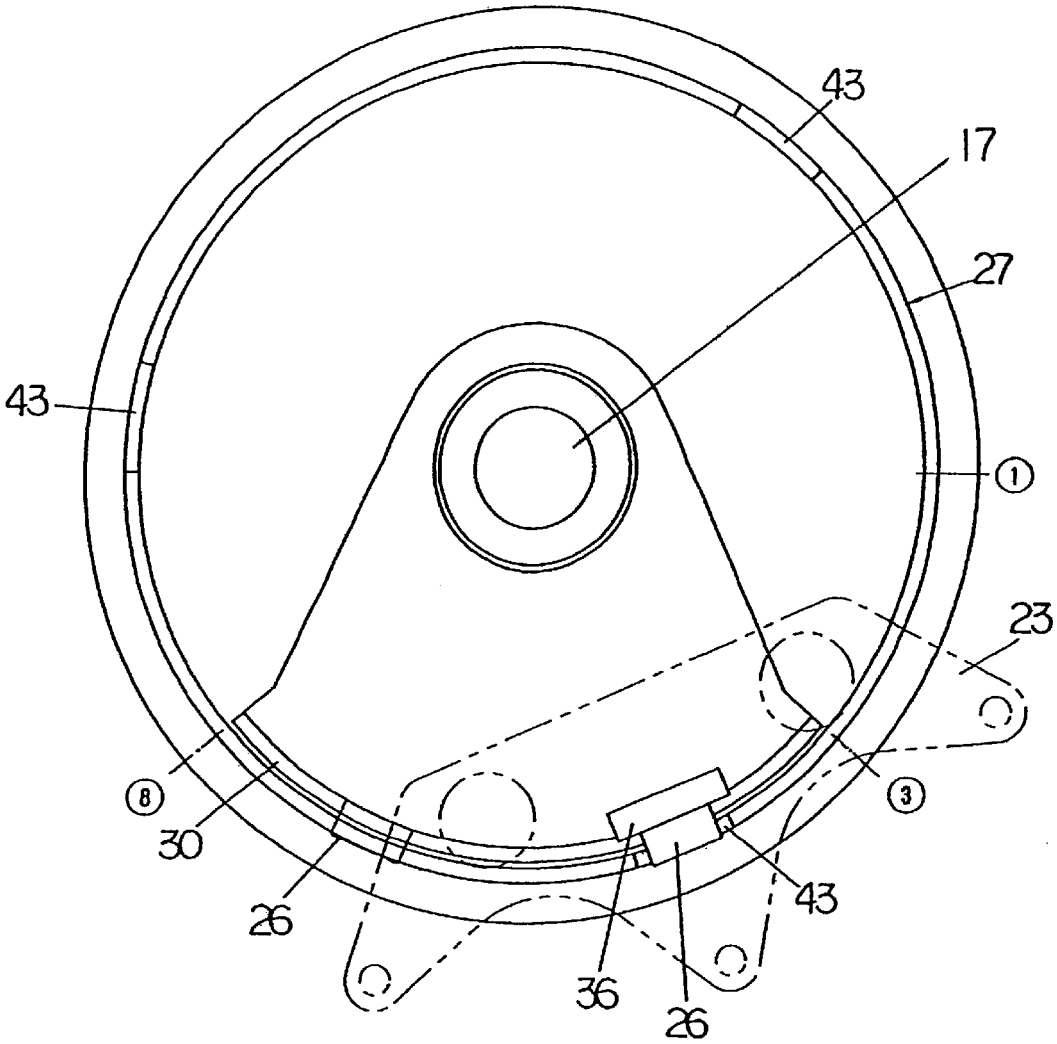
FIG. 4 is a diagram showing the relationship between the first and second raising-and-lowering cams and the cam roller; ①, ③ and ⑧ in FIG. 4 corresponding respectively to ①, ③ and ⑧ in FIG. 5.
Figure 5:
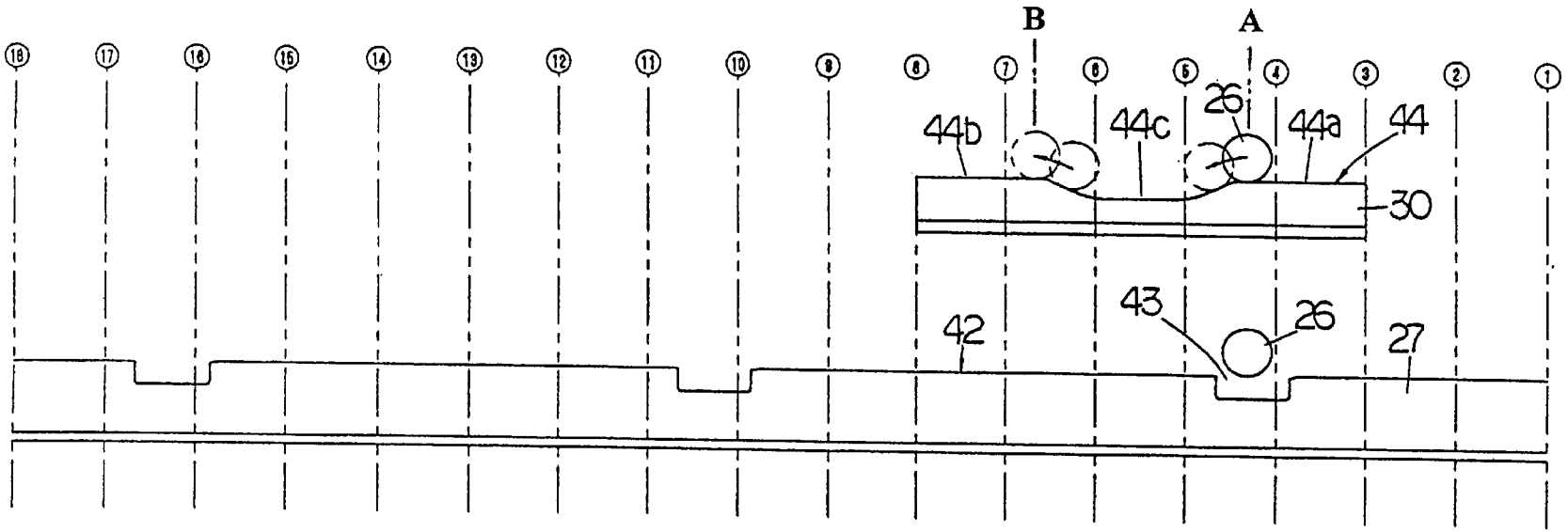
FIG. 5 shows the first and second raising-and-lowering cams unfolded into a flat fashion and further illustrates the relationship of the cams with the cam roller, wherein the circumference of 360 degrees of the cams are divided into 18 equal parts.

As seen from FIGS. 4 and 5, the cam surface 42 of the first raising-and-lowering cam 27 has a fixed height (see FIG. 5) and provided with recessed portions 43 at predetermined angular intervals (120 degrees). On the other hand, the cam surface 44 of the second raising-and-lowering cam 30 has cam surfaces 44*a* and 44*b* on both sides and a lower cam surface 44*c* between these cam surfaces 44*a* and 44*b*. The cam surfaces 44*a* and 44*b* have substantially the same height as the cam surface 42 of the first raising-and-lowering cam 27 (it is actually desirable to set this height to be the same as or slightly lower than that of the cam surface 42). These cam surfaces 44*a*, 44*b* and 44*c* are formed in a smoothly continuous manner.

The recessed portions 43 of the first raising-and-lowering cam 27 are formed so that these recessed portions 43 extend to a depth that is deeper than the height of the cam surface 44*c* of the second raising-and-lowering cam 30. Timing-wise, the reciprocating pivot motion of the pivot member 21 is set so that the first raising-and-lowering cam 27 is positioned in one of the recessed portions 43 during the advancing motion of the pivot member 21.

The operation of the liquid-form substance filling apparatus will be described below in order.

(1) When the pivot member 21 is in its advancing motion starting position (the position shown in FIG. 1), the cam roller 26 is in the position indicated by a solid line in FIG. 4 (i.e., the position indicated by A in FIG. 5) and is rolling on the cam surface 42 of the first raising-and-lowering cam 27 which is rotating at a constant speed together with the sprocket 1.

(2) When the recessed portion 43 of the first raising-and-lowering cam 27 reaches the position of the cam roller 26 as shown in FIG. 4, the bags W held by the respective grippers 3 are positioned directly beneath the respective filling nozzles 25. In this case, the cam roller 26 leaves the cam surface 42 of the first raising-and-lowering cam 27 and is carried on the cam surface 44*a* of the second raising-and-lowering cam 30. At the same time, the pivot member 21 initiates its advancing motion.

(3) The pivot member 21 pivots at the same angular velocity as the sprocket 1, and the respective filling nozzles 25 are moved in synchronism with the respective bags W at the same speed as the respective bags W for a specified angular range. During this movement, the cam roller 26 rolls from the cam surface 44*a* onto the cam surface 44*c* of the second raising-and-lowering cam 30. As a result, the rising-and-lowering assembly 23 is lowered and so are the respective filling nozzles 25 provided on the rising-and-lowering assembly 23. As a result, the tip ends of the filling nozzles 25 are inserted into the bags W from the mouths of the bags, and a specified amount of a liquid-form substance is discharged into the bags W, so that the bags W are filled.

(4) The pivot member 21 advances even further, and the cam roller 26 rolls from the cam surface 44*c* onto the cam surface 44*b* of the second raising-and-lowering cam 30. As a result, the rising-and-lowering assembly 23 is raised and so are the respective filling nozzles 25, so that the filling nozzles 25 are separated from the bags W. When the pivot member 21 reaches the advancing motion ending position, the cam roller 26 reaches the position indicated by the imaginary line in FIG. 4 (i.e., the position indicated by B in FIG. 5). Furthermore, the filling nozzles 25 reach the positions indicated by the imaginary lines in FIG. 1.

(5) After reaching the advancing motion ending position, the pivot member 21 immediately initiates its return motion. During this period as well, the first raising-and-lowering cam 27 rotates at a constant speed together with the sprocket 1; and the cam roller 26 leaves the cam surface 44*b* of the second raising-and-lowering cam 30 and is carried on the cam surface 42 of the first raising-and-lowering cam 27, so that the rising-and-lowering assembly 23 and filling nozzles 25 make the return motion while maintaining their raised positions. The pivot member 21 then reaches the advancing motion starting position and stops, after which the pivot member 21 waits in this position until the start of the next advancing motion.

As seen from the above, the packaging processing means, which are the filling nozzles in the shown embodiment, are raised and lowered merely by causing the pivot member to perform its reciprocating pivot motion. Accordingly, the mechanism for raising and lowering and reciprocating the packaging processing apparatus has a simple structure, so that the cost can be reduced, and maintenance and cleaning characteristics are improved. Furthermore, the two raising-and-lowering cams support only the rising-and-lowering assembly and the packaging processing means and cause these elements to move up and down. Accordingly, the load on the cams is small, and especially the rising-and-lowering mechanism of the packaging processing apparatus can be reduced in size.

What is claimed is:

1. A packaging processing apparatus used in a packaging machine, wherein said packaging machine comprises:

a rotating body that is attached to a rotating shaft connected to a driving means, said rotating body being rotated at a constant speed on a horizontal plane, and a plurality of container holding means that, upon rotation of said rotating body, are moved continuously at a constant speed and a uniform spacing along a predetermined-shape traveling path around a circumference of said rotating body; and specified packaging processing operations are performed, by a plurality of packaging processing means, on containers during a movement of respective container holding means along said predetermined-shape traveling path, said packaging processing means being arranged in a form of a circular arc so as to correspond to said container holding means at a same pitch as said containers held by said container holding means and performing a synchronous movement for a specified range at a same speed as said containers held by said container holding means, and wherein said packaging processing apparatus is comprised of:

a pivot member which is disposed above said rotating body, said pivot member being concentric with said rotating shaft and being connected to a driving means so that said pivot member performs a reciprocating pivot motion on a horizontal plane, a rising-and-lowering assembly which is disposed on said pivot member so that said rising-and-lowering assembly is freely raised and lowered and pivoted together with said pivot member, a circular first raising-and-lowering cam which is disposed concentrically with said rotating body and rotated together with said rotating body, a circular-arc-shaped second raising-and-lowering cam which is provided concentrically with said rotating body above said rotating body, a rolling member which is attached to said rising-and-lowering assembly and rolls over cam surfaces of said first and second raising-and-lowering cams so that said rising-and-lowering assembly is raised and lowered at a specified timing, and a plurality of said packaging processing means which are disposed on said rising-and-lowering assembly and perform a reciprocating motion as said pivot member pivots; and said rising-and-lowering assembly is subjected to an action of said second raising-and-lowering cam during an advancing motion of said pivot member and is subjected to an action of said first raising-and-lowering cam during a return motion of said pivot member.

2. The packaging processing apparatus used in a packaging machine according to claim 1, wherein said rising-and-lowering assembly is lowered and raised during an advancing motion of said pivot member and is maintained in a raised position during a return motion of said pivot member.

3. The packaging processing apparatus used in a packaging machine according to claim 2, wherein said first raising-and-lowering cam is provided with a cam surface having a uniform height and a plurality of recessed portions formed at predetermined angular intervals, and said second raising-and-lowering cam is provided on both sides thereof with cam surfaces that have substantially a same height as said cam surface of said first raising-and-lowering cam and is further provided with a lower cam surface between said cam surfaces on said both sides; and wherein, during said advancing motion of said pivot member, said rolling member is positioned in one of said recessed portions of said first raising-and-lowering cam and rolls over said cam surface of said second raising-and-lowering cam, thus allowing said rising-and-lowering assembly to be lowered and raised, and during said return motion of said pivot member, said rolling member rolls over said cam surface of said first raising-and-lowering cam, thus allowing said rising-and-lowering assembly to be maintained in said raised position.

4. The packaging processing apparatus used in a packaging machine according to claim 3, wherein said packaging processing means are filling nozzles for a liquid-form substance.

5. The packaging processing apparatus used in a packaging machine according to claim 2, wherein said packaging processing means are filling nozzles for a liquid-form substance.

* * * * *